US006146582A

United States Patent [19]

Lindén

[11] Patent Number: 6,146,582

[45] **Date of Patent: *Nov. 14, 2000**

[54] AUSTENITIC STAINLESS STEEL WITH GOOD OXIDATION RESISTANCE

[75] Inventor: Johan Lindén, Gävle, Sweden

[73] Assignee: Sandvik AB, Sandviken, Sweden

[ * ] Notice: This patent is subject to a terminal disclaimer.

[21] Appl. No.: 09/204,358

[22] Filed: Dec. 4, 1998

[30] Foreign Application Priority Data

May 12, 1997 [SE] Sweden ..... 9704538

[51] Int. Cl.[7] ..... C22C 38/48; C22C 38/50

[52] U.S. Cl. ..... 420/40; 420/53; 420/54

[58] Field of Search ..... 420/40, 53, 54

[56] References Cited

U.S. PATENT DOCUMENTS 5,824,264 10/1998 Uno et al. ..... 420/40
5,827,476 10/1998 Lindén et al. .

FOREIGN PATENT DOCUMENTS

WO 89/09843 10/1989 WIPO .

*Primary Examiner*—Deborah Yee

*Attorney, Agent, or Firm*—Burns, Doane, Swecker & Mathis, L.L.P.

[57] ABSTRACT

A new austenitic stainless steel alloy is provided (in wt. %) according to the following analysis:

C: less than 0.12%;
Si: less than 1.0%;
Cr: 16–22%;
Mn: less than 2.0%;
Ni: 8–14%;
Mo: less than 1.0%;
S: less than 0.03%;
O: less than 0.03%;
N: less than 0.05%;
La: between 0.02% and 0.11%; and one of the following:

(i) Ti in an amount at least 4 times the amount of carbon and 0.80% or less, or (ii) Nb in an amount at least 8 times the amount of carbon and 1.0% or less;

the remainder Fe and normally occurring impurities. The new steel is particularly suitable as a super heater steel and a heat exchanger steel.

10 Claims, 1 Drawing Sheet

AUSTENITIC STAINLESS STEEL WITH GOOD OXIDATION RESISTANCE

BACKGROUND OF THE INVENTION

Materials that are used in high temperature applications, such as boilers, must have good oxidation and corrosion resistance, strength at increased temperatures and structural stability. Structural stability implies that the structure of the material during operation shall not degenerate into fragility-causing phases which lower the strength of the material. The choice of material depends on the temperature and the load, and of course, on the cost. Oxidation resistance, which is of considerable importance for the present invention, means the resistance of the material against oxidation in the environment to which it is subjected. In applications such as boilers, the environment includes the presence of high temperatures. Under oxidation conditions, i.e., in an atmosphere that contains oxidizing gasses (primarily oxygen and water vapor), an oxide layer is formed on the steel surface. When the oxide layer attains a certain thickness, oxide flakes detach from the surface. This phenomenon is called scaling. With scaling, a new metal surface is exposed, which also oxidizes. Therefore, since the steel is continuously transformed into its oxide, its load-carrying capability will gradually deteriorate.

Scaling may also result in other problems. In superheater tubes, the oxide flakes are transported away by the vapor and if accumulations of these flakes are formed, e.g., inside tube bends, the vapor flow in the tubes may be blocked and potentially cause a break-down in the boiler system because of overheating. Further, the oxide flakes may cause so called "solid particle erosion" in the turbine system. Problems caused by scaling can manifest themselves in the form of a lower boiler effectiveness, unforeseen shutdowns for repairs and high repairing costs. A reduction in scaling problems make it possible to run the boiler with a higher vapor temperature, which brings about an increased power economy.

Thus, a material with good oxidation resistance should be capable of forming an oxide that grows slowly and that has a good adhesion to the metal surface so that it will not flake off. The higher the temperature that the material is subjected to, the stronger the tendency for oxide formation. A measure of the oxidation resistance of the material is the so called scaling temperature, which is defined as the temperature at which the oxidation-related loss of material amounts to a certain value, for instance 1.5 $g/m^2$-h.

At increased temperature, the material is subjected to creep deformation. An austenitic basic mass, which is obtained by the addition of an austenite stabilizing substance such as nickel, improves the creep strength, as does precipitations of a minute secondary phases, such as carbides.

A conventional way to improve the oxidation resistance is to add chromium, which promotes the formation of a protective oxide layer. The alloying of chromium into steel brings about an increased tendency to separate the so called "sigma phase". This tendency may be counteracted, as indicated above, by the addition of austenite-stabilizing nickel.

Both manganese and nickel have a positive influence on the structural stability of the material. Both these elements function as austenite-stabilizing elements, i.e., they counteract the separation of fragility-causing sigma phase during operation. Manganese also improves the heat check resistance during welding, by binding sulphur. Good weldability constitutes another important property for the material.

Austenitic stainless steels of the type 18Cr-10Ni have a favorable combination of the above-mentioned properties and are therefore often used for high temperature applications. A frequently occurring alloy of this type is SS2337 (AISI Type 321), corresponding to Sandvik 8R30. The alloy has a good strength, thanks to the addition of titanium, and good corrosion resistance. Therefore, it has been used in tubes for superheaters in power plants. However, the oxidation resistance of the alloy is limited, which brings about the above-mentioned problems resulting in limitations with regard to operable life and maximum temperature of use.

Soviet inventor's certificate SU 1 038 377 discloses a steel alloy which is said to be resistant to stress corrosion, primarily in a chlorine-containing environment. However, stress corrosion involves substantially lower temperatures than those encountered in superheater applications. The alloy described in SU 1038377 contains (in weight %) 0.03–0.08 C, 0.3–0.8 Si, 0.5–1.0 Mn, 17–19 Cr, 9–11 Ni, 0.35–0.6 Mo, 0.4–0.7 Ti, 0.008–0.02 N, 0.01–0.1 Ce and the remainder Fe. The heat check resistance and weldability of the alloy are unsatisfactory.

OBJECTS AND SUMMARY OF THE INVENTION

An object of the present invention is to provide a steel of the 18Cr-10Ni type that has a very good oxidation resistance, and thereby an extended life, under high temperature conditions, primarily in a vapor-containing environment.

Another object of the present invention is to provide a steel of the 18Cr-10Ni type that has an increased maximum temperature of use.

These and further objects have been unexpectedly attained by providing a steel having a composition defined in weight % as follows:

C: less than 0.12;
Si: less than 1.0;
Cr: 16–22;
Mn: less than 2.0;
Ni: 8–14;
Mo: less than 1.0;
S: less than 0.03;
O: less than 0.03;
N: less than 0.05;
La: 0.02 min and 0.11 max; and
one of the following:
(i) Ti in an amount at least 4 times the amount of carbon and 0.80% or less, or
(ii) Nb in an amount at least 8 times the amount of carbon and 1.0% or less;
the remainder Fe with normally occurring impurities.

Another aspect of the present invention involves a component of a carbon boiler, heat exchanger, or ethene oven formed of an austenitic stainless steel having the above-described composition.

Yet another aspect of the present invention involves a method of using an austenitic stainless steel having the above-described composition, wherein said method includes forming at least part of a component of one of a carbon boiler, heat exchanger, or ethene oven from the austenitic stainless steel.

BRIEF DESCRIPTION OF THE DRAWING FIGURES

FIG. 1 is a graph showing weight change during oxidation in water vapor vs. testing time for various illustrative alloy compositions; and FIG. 2 is a graph showing contraction plotted vs. temperature for various illustrative alloy compositions.

DETAILED DESCRIPTION OF PREFERRED EMBODIMENTS OF THE INVENTION

Figure 1:
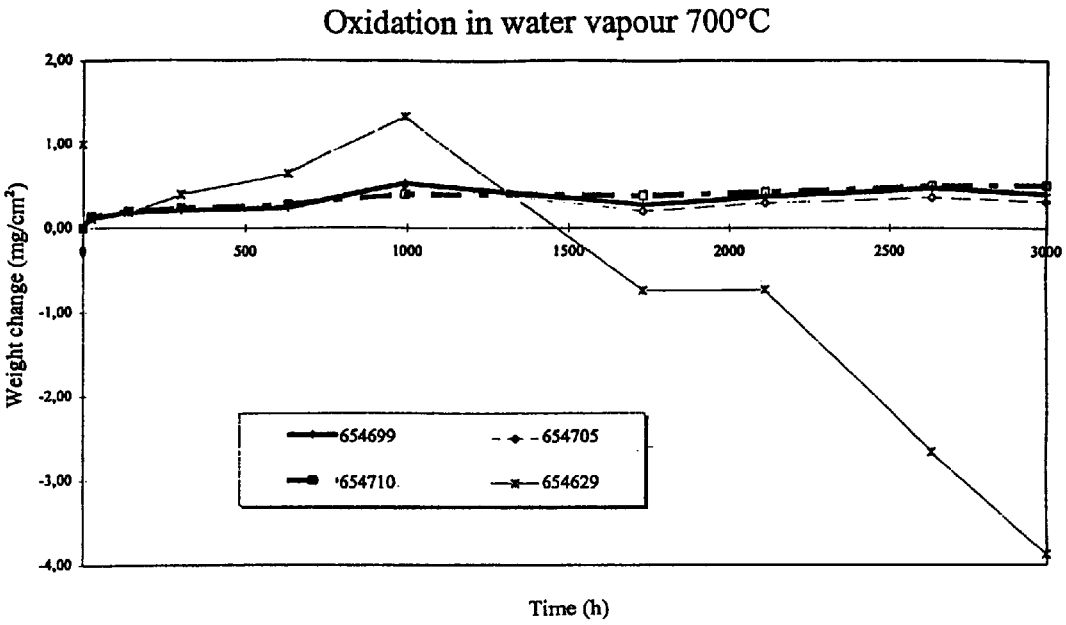

One essential feature of an alloy of the present invention is that a rare earth metal such as pure lanthanum is present in the alloy composition. The addition of pure La has resulted in a surprisingly good oxidation resistance in air as well as in water vapor, and good strength and corrosion properties. Extensive investigations have shown that the addition of a rare earth metal such as La, in an amount ranging from 0.02–0.11 wt. % results in optimal oxidation resistance and hot workability. Without being bound by any underlying theory, the improvement of the oxidation properties is considered to depend upon the content of rare earth metal dissolved in the steel. In order to permit the rare earth metal to dissolve in the steel it is important to keep down the amount of elements such as S, O and N.

The composition of an alloy formed consistent with the principles of the present invention may include: carbon, silicon, chromium, manganese, nickel, molybdenum, titanium, niobium, oxygen, nitrogen, sulfur, a rare earth metal such as lanthanum, and iron.

Carbon along with Ti, give the material sufficient creep strength. Excessive amounts of carbon result in the precipitation of chromium carbides, which has two negative effects:

a) Precipitation of carbides at grain borders brings about an increased risk of intercrystalline corrosion, i.e., the material is "sensitized"; and b) The chromium carbides bind chromium, which deteriorates the oxidation resistance of the material.

For these reasons, a maximum carbon content of 0.12 wt. % is chosen, preferably a maximum of 0.10 wt. %, most preferably between 0.04 and 0.08 wt. %.

Silicon contributes to good weldability and castability. Excessive amounts of silicon can cause brittleness. Therefore, a maximum silicon content of 1.0 wt. % is suitable, preferably a maximum of 0.75 wt. %, and most preferably an amount between 0.3 and 0.7 wt. %.

Chromium contributes to good corrosion and oxidation resistance. However, chromium is a ferrite-stabilizing element and an excessive Cr content brings about an increased risk of embrittlement by the creation of a so called σ-phase (sigma phase). For these reasons, a chromium content of between 16 and 22 wt. % is chosen, preferably between 17 and 20 wt. %, and most preferably between 17 and 19 wt. %.

Manganese has a high affinity to sulphur and forms MnS. The presence of MnS improves the workability and thereby facilitates production of finished articles, such as superheater tubes. MnS also improves resistance to the formation of heat checks during welding. Further, manganese is austenite stabilizing, which counteracts any embrittlement. On the other hand, Mn makes the alloy more costly. For these reasons, the maximum manganese content is suitably set to 2.0 wt. %, preferably between 1.3 and 1.7 wt. %.

Nickel is austenite-stabilizing and is added to obtain an austenitic structure, which gives improved strength and counteracts embrittlement. However, as with manganese, nickel contributes to the cost of the alloy. For these reasons, the nickel content is suitably set to between 8 and 14 wt. %, preferably between 9.0 and 13.0 wt. %, and most preferably between 9.5 and 11.5 wt, %.

Molybdenum favors the precipitation of embrittling σ-phase. Therefore, the Mo content should not exceed 1.0 wt. %.

Titanium has a high affinity to carbon and, by the formation of carbides, improves creep strength. Titanium in solid solution also contributes to good creep strength. Since Ti binds carbon, the risk of separation of chromium carbide in the grain borders (so called "sensitizing") is reduced. On the other hand, excessive Ti content causes brittleness. For these reasons, the Ti content should not be lower than 4 times the carbon content, and not exceed 0.80 wt. %.

Alternatively, the steel may be stabilized by niobium instead of titanium. For the same reasons noted above in connection with titanium, the niobium content should not be less than 8 times the carbon content, and not exceed 1.0 wt. %.

Oxygen, nitrogen and sulphur normally binds the chosen rare earth metal in the form of oxides, nitrides and sulphides, which do not contribute to improved oxidation resistance. For these reasons, each one of the S and O contents should not exceed 0.03 wt. %, and the N content not exceed 0.05 wt. %. Preferably, the S and the O content should not exceed 0.005 wt. % and the N content not exceed 0.02 wt. %.

As mentioned above, Lanthanum improves the oxidation resistance. Below a certain amount this effect is not apparent. No further improvement of the oxidation resistance is achieved after the addition above a certain limit. For these reasons, the lanthanum content is suitably chosen to between 0.02 and 0.11 wt. %, preferably between 0.05–0.10 wt. %.

Melts with different compositions were produced by melting in a HF oven and casting into ingots. The chemical composition of the ingots are shown in the following Table 1. From the ingots 10 mm thick plates were sawn across the ingot. The plates were then hot-rolled to a thickness of about 4 mm. The object of this procedure was to break down the as-cast structure and obtain an even grain size. At the same time, an indication is of the hot workability of the alloy can be obtained during rolling. The rolled plates were then annealed according to the practice for this steel type, which means a holding time of 10 minutes at 1055° C., followed by water quenching.

| | | Charge nr | | | | | |
|---|---|---|---|---|---|---|---|
| | | 654629 | 654695 | 654699 | 654705 | 654710 | 654696 |
| Carbon | (wt. %) | 0.078 | 0.063 | 0.067 | 0.064 | 0.063 | 0.063 |
| Silicon | (wt. %) | 0.39 | 0.40 | 0.42 | 0.42 | 0.40 | 0.40 |
| Manganese | (wt. %) | 1.49 | 1.44 | 1.53 | 1.51 | 1.46 | 1.48 |
| Phosphorus | (wt. %) | 0.023 | 0.024 | 0.025 | 0.024 | 0.023 | 0.023 |
| Sulfur | (wt. %) | 6 | 12 | 10 | 5 | 9 | 5 |
| Chromium | (wt. %) | 17.31 | 17.42 | 17.34 | 17.31 | 17.51 | 17.47 |
| Nickel | (wt. %) | 10.11 | 10.26 | 10.17 | 10.17 | 10.15 | 10.19 |
| Molybdenum | (wt. %) | 0.19 | 0.26 | 0.26 | 0.25 | 0.25 | 0.26 |
| Titanium | (wt. %) | 0.51 | 0.42 | 0.45 | 0.41 | 0.43 | 0.41 |

-continued

| | | Charge nr | | | | | |
|---|---|---|---|---|---|---|---|
| | | 654629 | 654695 | 654699 | 654705 | 654710 | 654696 |
| Nitrogen | (wt. %) | 0.008 | 0.009 | 0.010 | 0.010 | 0.011 | 0.011 |
| Cerium | (wt. %) | <0.01 | <0.01 | <0.01 | <0.11 | <0.01 | 0.05 |
| Lanthanum | (wt. %) | <0.005 | <0.005 | <0.11 | <0.005 | 0.05 | <0.005 |
| Neodymium | (wt. %) | <0.005 | <0.005 | <0.005 | <0.005 | <0.005 | <0.005 |
| Praseodymium | (wt. %) | <0.005 | <0.005 | <0.005 | <0.005 | <0.005 | <0.005 |
| Rare earth Metal | (wt. %) | <0.01 | <0.01 | 0.11 | 0.11 | 0.05 | 0.05 |
| Oxygen | (ppm) | 22 | 31 | 31 | 29 | 54 | 62 |

For the oxidation testing, rectangular so called "oxidation coupons" were cut out in a size of 15×30 mm, the surface of which was ground with a 200 grain grinding paper. The coupons were then oxidized over 3000 hours in water vapor at 700° C.

The result may be seen in FIG. 1, where the weight change during oxidation in water vapor has been plotted as a function of testing time for the various melt compositions.

From FIG. 1 it can be seen that for SS2337 without any rare earth metals (charge 654695), the weight diminishes after 1000 h in vapor at 700° C., which means that the material peels, i.e., oxide flakes fall off. For the charges that have been alloyed with pure lanthanum and with other rare earth metals, only a weak weight change takes place, which indicates that the material forms an oxide with good adhesion. As mentioned above, this is a desirable property for alloys that are used in superheater tubes.

Figure 2:
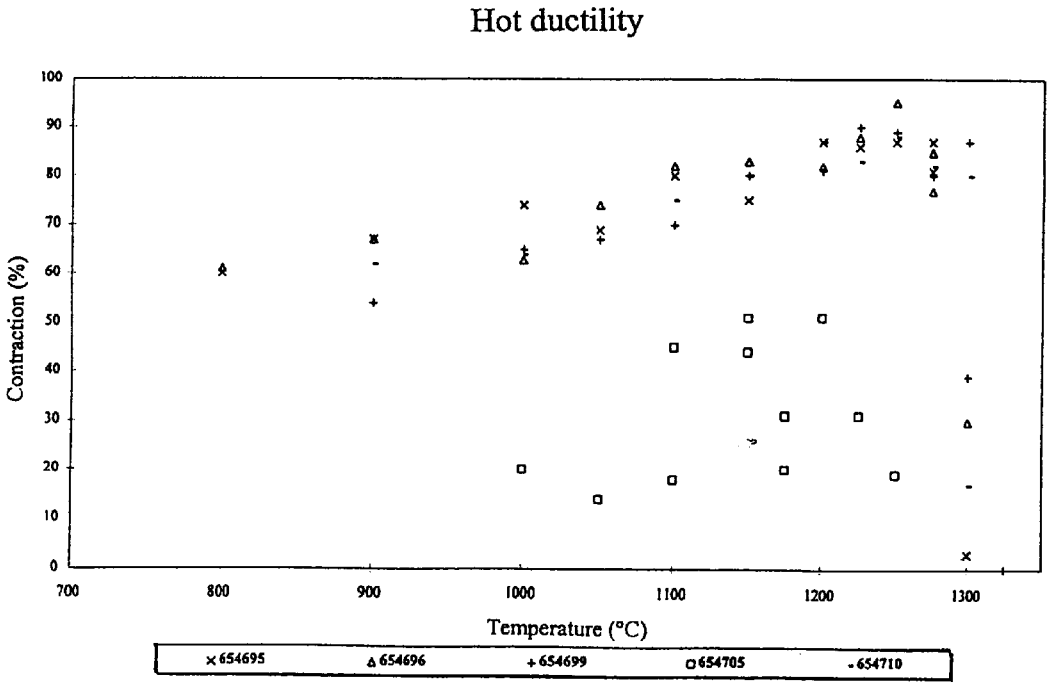

An investigation was performed in order to find out the influence on the hot workability properties for the rare earth metals Ce and La. Charges were produced according to the procedure described above and were subsequently hot tensile tested at different temperatures. The results in FIG. 2 show that lanthanum does not have a negative effect on hot workability, which is also the case with Ce.

The improvement of the oxidation properties comes from the content of La present in solution in the steel. Elements such as sulphur, oxygen and nitrogen react easily with La already in the steel melt and forms stable sulphides, oxides and nitrides. La bound in these compounds cannot appreciably affect the oxidation properties, therefore the S, O and N contents should be kept low.

The performed creep testing demonstrates no impaired creep strength for the rare earth metal alloyed material.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes, and equivalents which fall within the spirit and scope of the invention be embraced thereby.

What is claimed is:

1. An austenitic stainless steel comprising in weight percent:

C: less than 0.12%;

Si: less 1.0%;

Cr: 16–22%;

Mn: less than 2.0%;

Ni: 8–14%;

Mo: less than 1.0%;

S: less than 0.03%;

O: less than 0.03%;

N: less than 0.05%;

La: between 0.02% and 0.11%; and one of the following:

(i) Ti in an amount at least 4 times the amount of carbon and 0.80% or less, or (ii) Nb in an amount at least 8 times the amount of carbon and 1.0% or less;

the remainder Fe and normally occurring impurities.

2. The steel according to claim 1, wherein the carbon content is between 0.04 and 0.08%.

3. The steel according to claim 1, wherein the silicon content is between 0.3 and 0.7%.

4. The steel according to claim 1, wherein the chromium content is between 17 and 20%.

5. The steel according to claim 1, wherein the manganese content is between 1.3 and 1.7%.

6. The steel according to claim 1, wherein the nickel content is between 9.0 and 13.0%.

7. The steel according to claim 1, wherein the La content is between 0.05% and 0.10%.

8. A component of one of the following:

a carbon boiler, a heat exchanger, and an ethene oven;

said component made from the stainless steel of claim 1.

9. A method of using the austenitic stainless steal alloy of claim 1, said method comprising: forming at least part of a component of a carbon boiler, heat exchanger, or ethane oven from said steel alloy.

10. A method of using the austenitic stainless steel alloy of claim 1, said method comprising: forming at least part of superheater tube from said steel alloy.

* * * * *